United States Patent [19]

Tyree, Jr.

[11] 4,100,759

[45] Jul. 18, 1978

[54] $CO_2$ VEHICLE REFRIGERATION SUPPORT SYSTEMS

[76] Inventor: Lewis Tyree, Jr., 145 Briarwood Ave., North, Oak Brook, Ill. 60521

[21] Appl. No.: 737,439

[22] Filed: Nov. 1, 1976

[51] Int. Cl.[2] ..... F17C 7/02

[52] U.S. Cl. ..... 62/55; 62/165; 62/332; 62/514 R

[58] Field of Search ..... 62/45–48, 62/165, 332, 384, 514 R, 239, 55

[56] References Cited

U.S. PATENT DOCUMENTS

| | | | |
|---|---|---|---|
| 3,754,407 | 8/1973 | Tyree, Jr. | 62/55 |
| 3,802,212 | 4/1974 | Martin et al. | 62/52 |
| 3,810,365 | 5/1974 | Hampton et al. | 62/48 |
| 3,984,993 | 10/1976 | Muska | 62/45 |

*Primary Examiner*—Ronald C. Capossela
*Attorney, Agent, or Firm*—Fitch, Even, Tabin & Luedeka

[57] ABSTRACT

A system for filling vehicle tanks with low pressure liquid carbon dioxide. A holding chamber is supplied with high pressure liquid $CO_2$ from a storage vessel system, and the pressure of liquid $CO_2$ is reduced to about 60 psig or below to create $CO_2$ vapor and $CO_2$ snow and form a low-temperature coolant reservoir in the holding chamber. $CO_2$ vapor from the chamber is compressed and returned to the storage vessel system. Liquid $CO_2$ from the storage vessel system can be supplied simultaneously to several vehicle tanks at below about 125 psig, and vapor created as a result thereof is condensed by melting $CO_2$ snow in the holding chamber. Standby cooling of vehicle compartments is provided by vaporizing liquid $CO_2$ from a vehicle tank in a heat exchanger for vaporization therein, expanding the vapor to cool it and then passing the expanded vapor through a second heat exchanger. An auxiliary compressor withdraws the expanded vapor from the second heat exchanger and compresses withdrawn vapor sufficient to inject it into the holding chamber where it is condensed by melting the snow.

10 Claims, 1 Drawing Figure

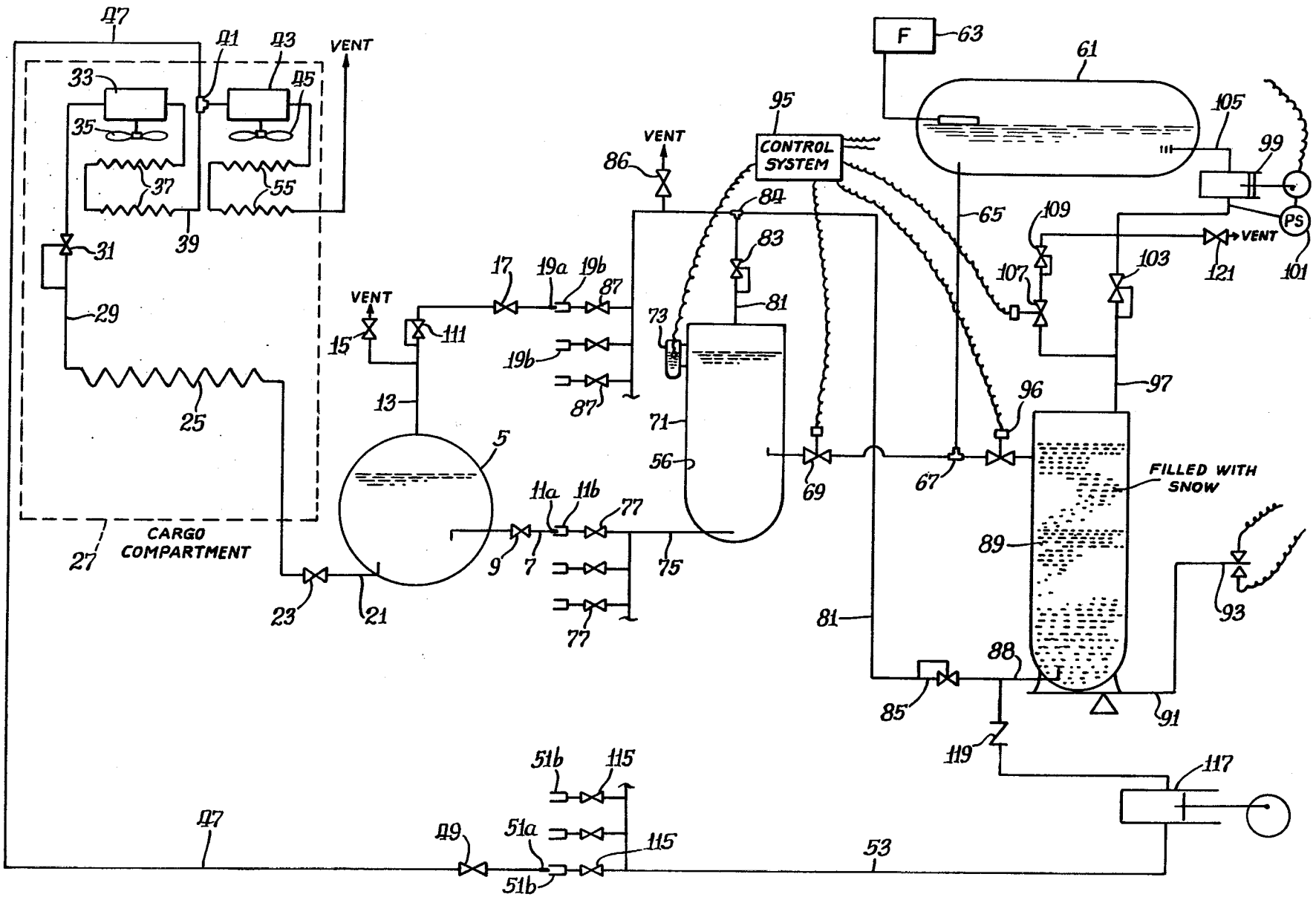
FILLED WITH SNOW
CONTROL SYSTEM
VENT
VENT
VENT
CARGO COMPARTMENT
F
PS

$CO_2$ VEHICLE REFRIGERATION SUPPORT SYSTEMS

This invention relates to the carbon dioxide cooling of refrigerated vehicles, and more specifically to an arrangement for efficiently and economically filling the storage tanks of such vehicles with liquid carbon dioxide and for providing standby cooling for such vehicles.

Although both mechanical and cryogenic systems have been developed in the past for cooling refrigerated vehicles, the industry has continued to search for better and improved versions of vehicle cooling systems. For example, U.S. Pat. No. 3,802,212, issued Apr. 9, 1974 and No. 3,374,640, issued Mar. 26, 1968 illustrate the use of liquid nitrogen cooling units for trucks and like refrigerated vehicles. My co-pending application Ser. No. 708,268, now U.S. Pat. No. 4,045,972 filed July 23, 1976, illustrates a vehicle cooling system utilizing liquid carbon dioxide which is believed to have significant advantages over prior art cooling systems of this general type.

It is an object of the present invention to provide an improved support arrangement for filling vehicle tanks with low pressure liquid carbon dioxide. A further object of the invention is to provide an improved system for simultaneously filling the tanks of a number of refrigerated vehicles with liquid carbon dioxide. Another object is to provide an efficient system for cooling of the cargo compartments of such vehicles on a standby basis while filling of vehicle tanks is simultaneously occurring. These and other objects of the invention will be apparent from the following detailed description of a preferred embodiment of an installation embodying the invention, particularly when read in combination with the single FIGURE of the appended drawing.

An efficient and economical installation for supplying refrigerated trucks with low pressure liquid carbon dioxide has been created which is capable of supplying the peak demand of a number of trucks simultaneously, without the requirement of an expensive, large capacity compressor and its associated high horsepower electric motor and power supply. By creating and preserving a reservoir of carbon dioxide snow, a ready sump is provided for the carbon dioxide vapor which will be created during the time of the peak demand, and as a result the installation allows both the simultaneous filling multiple vehicle tanks with low pressure carbon dioxide and the standby cooling of their cargo compartments with recovery of substantially all of the carbon dioxide vapor created.

Depicted in the FIGURE is a system which is designed to store refrigerant for supply to refrigerated vehicles that employ liquid carbon dioxide for coolant. The basic refrigeration system for the vehicle is described in detail in my above-mentioned patent application Ser. No. 708,268, the disclosure of which is incorporated herein by reference. The system for filling the truck storage tanks is sometimes referred to as a ground support system, and it is designed to minimize the cost of operating such an overall, carbon dioxide, vehicle refrigeration system by (1) minimizing the cost of installed equipment and (2) recovering carbon dioxide vapor for compression and reliquefication whenever feasible.

Although the vehicle refrigeration system itself can take various different forms, one representative embodiment is shown for purposes of illustration for the present application.

Basically, the vehicle refrigeration system utilizes a liquid carbon dioxide storage tank 5, which may be mounted underneath the truck frame, and includes a liquid inlet line 7 that is equipped with a shut-off valve 9 and a coupling 11*a* for connection to the ground support system. A vapor return line 13 extends from an upper region of the tank 5. It includes a pressure relief valve 15 and similarly includes a shut-off valve 17 and a coupling 19*a* for connection to the ground support system.

A liquid feed line 21 runs from a lower portion of the storage tank 5 through a shut-off valve 23 to a heat exchanger 25, which is located in the cargo compartment 27 of the vehicle. The heat exchanger 25 is of sufficient length so that all of the liquid carbon dioxide turns to vapor therein, and the vapor exits through a line 29 which includes a back pressure regulator 31 that is set to maintain a pressure of at least 65 psig in the heat exchange coil to prevent the formation of solid carbon dioxide therein. The carbon dioxide vapor flowing through the line 29 enters a gas motor 33 which is drivingly connected to a blower fan 35 that causes circulation of the atmosphere throughout the cargo compartment 27 and in particular past the heat exchanger 25. Isentropic expansion takes place in the gas motor 33 and results in both a lowering of the pressure of the vapor as well as a lowering of its temperature.

The cold vapor then passes through a second heat exchanger 37, which may be arranged so that it also lies in the circulation path of the blower 35, and advantage is thus taken of the cooling capacity of this expanded vapor. The vapor exiting from the heat exchanger 37 travels through a line 39 to a tee connection 41. One leg of the tee 41 leads to a second gas motor 43, which is drivingly connected to a second blower 45, wherein further isentropic expansion occurs. The other leg of the tee 41 connects to a branch line 47 which contains a shut-off valve 49 and leads to a coupling 51*a* for connection to an auxiliary vapor return line 53 of the ground support system. The re-cooled vapor from the second motor 43 flows through a third heat exchanger 55 which lies in the circulation path of the second blower 45. After the cooling capacity of this re-cooled vapor is extracted, it is vented to the atmosphere exteriorly of the cargo compartment 27.

The ground support system includes a main storage vessel 61 together with a freon condenser 63 of appropriate size. A supply line 65 from a lower portion of the storage vessel 61 is directed to a tee connection 67, the left hand leg of which leads, via a solenoid-controlled valve 69 to an intermediate tank 71 which is provided with a liquid level control 73. A liquid outlet 75 from the intermediate tank 71 is branched, and each branch line includes a shut-off valve 77 and a coupling 11*b* for connection via coupling 11*a* to the liquid inlet 7 of a selected vehicle storage tank 5. A vapor outlet line 81 of the intermediate tank 71 contains a back pressure regulator 83 which is set to maintain a predetermined pressure, e.g., 95 psig., in the intermediate tank and which thus determines the amount of expansion and pressure drop that takes place as the high pressure liquid from the main storage vessel 61 is expanded thereto. The vapor line 81 is connected through a tee 84 to another pressure regulator 85, set at, for example, 65 psig., to a vapor inlet line 88 which leads to the bottom of a holding tank 89. The pressure regulator 85 prevents the formation of solid carbon dioxide in the lines and devices upstream thereof. The other leg of the tee 84 contains a relief valve 86 and leads to a branched line which includes pairs of shut-off valves 87 and the mating couplings 19*b*.

The holding tank 89 is supported on a balance 91, and a weight switch 93 is connected to a control system 95. When the holding tank 89 is being filled, liquid $CO_2$ flows through the right-hand line leading from the tee 67 via a solenoid-operated valve 96 until a predetermined weight is reached, which indicates that the holding tank is filled to the desired extent with high pressure liquid carbon dioxide. A vapor line 97 leads from the upper portion of the holding tank 89 and is branched to provide two parallel paths leading to a compressor 99 that is controlled by a pressure switch 101 that will cause the compressor to run whenever there is a minimum amount of vapor present.

During the initial filling of the holding tank 89, the vapor passes through a back pressure regulator 103 which may be set at about 65 psig. (which is above the triple point of carbon dioxide, i.e., about 60 psig and −70° F.), and the compressor automatically begins to run, as the pressure switch may be set for about 50 psig. The compressed vapor is raised to a pressure sufficient to cause it to flow through a return line 105 and bubble through a submerged inlet into the liquid portion of the main storage vessel 61.

As soon as the weight switch 93 indicates that the holding tank 89 has been filled with the desired amount of liquid, the control system 95 opens a solenoid-controlled valve 107 that provides a parallel path to the compressor 99 through a back-pressure regulator 109 that is set at the triple point or below, e.g., 55 psig. and thus allows the formation of solid $CO_2$ in the holding tank 89. As the compressor 99 slowly lowers the pressure, first slush is created, and then eventually the entire contents of the holding tank 89 is converted to $CO_2$ snow. This takes place over a number of hours, usually during the night or some other period of low demand, and the ground system is then fully charged and ready for operation. The compressor 99 runs continuously until the entire reservoir in the holding tank 89 has turned to snow, and when the compressor 99 shuts off, the control system 95 closes the valve 107 so the pressure in the tank 89 is allowed to slowly rise to the triple point.

The ground support system is coupled to a vehicle refrigeration system via connection of appropriate couplings 11*a* and *b*, 19*a* and *b* and 51*a* and *b*. The valves 9 and 17 are opened along with appropriate valves 77 and 87, and the cold liquid $CO_2$ from the intermediate tank 71 flows into the vehicle storage tank 5 through the line 75 and the coupling 11*a*, 11*b*. Flow occurs as the result of pressure differential, and the pressure in the vehicle tank is preferably controlled by a back-pressure regulator 111 which is set a few pounds below the regulator 83. The vapor from the tank 5 flows through the line 13 and the tee 84 where it enters the main vapor return line 81 which leads to the bottom of the holding tank 89.

Shortly after liquid $CO_2$ begins to flow from the intermediate storage tank 71, the liquid level controller 73 opens the solenoid-operated supply valve 69, via the control system 95 which also actuates the solenoid-operated valve 107 in the vapor line 97 to open the parallel path to the compressor 99 through pressure regulator 109, which is set at about 10 psi. below pressure regulator 103. Opening of the valve 107 allows the compressor 99 to get a head start, anticipating that vapor will soon be flowing to the holding tank 89, where the latent heat of the refrigeration reservoir of solid $CO_2$ stands available to assist the compressor 99 in condensing the incoming vapor. As soon as the flow of vapor through the line 88 reaches the tank 89, melting of the $CO_2$ snow to slush begins accompanied concurrently with liquefication of the incoming vapor. The compressor is of course working to remove vapor and convert the liquid back to snow; however, a net increase in liquid in the tank occurs when the rate of vapor inflow exceeds the capacity of the compressor 99.

When it is desired to cool the cargo compartment 27 of a vehicle while the vehicle is still coupled to the ground support system, the valve 23 in the liquid feed line 21, the valve 49 and a valve 115 in the secondary vapor recovery line 53 are opened. As a result, liquid carbon dioxide at, for example, a pressure of about 90 psig. flows into the main heat exchanger 25 and vaporizes. The vapor is expanded and cooled in the first air motor 33, and then provides further cooling for the cargo compartment 27 as it passes through the second heat exchanger 37. In order to recover the carbon dioxide vapor that is being used for this standby cooling of the cargo compartment 27, the branch line 47 is utilized. Thus, the vapor from the second heat exchanger 37 is sucked through coupling 51*a*, *b* and through the auxiliary vapor recovery line 53 to a small auxiliary compressor 117, which is sized to take the vapor, that may be at about 25 psig. and raise it to a sufficient pressure, i.e., in the neighborhood of about 60–70 psig., so that it will flow through a check valve 119 and into the main vapor recovery line 88 leading to the holding tank 89. Thus, this compressed vapor is condensed to liquid by the snow or slush reservoir that has been built up in the tank; and accordingly, the system provides for standby cooling of the cargo compartments 27 of vehicles without expending liquid carbon dioxide.

As indicated by the plural couplings 11*b*, 19*b* and 51*b*, the ground support system is designed to supply liquid carbon dioxide at cold temperatures and relatively low pressure simultaneously to a plurality of vehicles. In the preferred form, all of the fluid flow is by pressure differential, and no auxiliary pumping equipment is required. As a part of the design of the system, a low temperature low pressure liquid reservoir is preferably built up in the tank 71 which is ready for prompt flow at any time to the individual vehicle tanks 5. More importantly, either during off periods or at night, the large holding tank 89 full of carbon dioxide snow is created, which then stands ready to condense the vapor which will be created during a peak time of filling individual vehicle tanks and/or cooling still coupled vehicles.

All of the foregoing is accomplished without the need for a large horsepower motor to drive a high capacity compressor, that would otherwise be needed to handle all of the vapor that would be created during peak demand periods. Instead, a relatively small sized compressor 99 can adequately handle the job because its period of operation is stretched out over a good deal of the 24-hour day. However, should a peak demand of unusually long duration occur, so that all the snow in the holding tank 89 is melted and the pressure in the tank 89 climbs past a set upper limit of about 70 psig., a spring-loaded relief valve 121 opens and vents the ground support system, as needed, to keep the pressure within the working design so as to allow the continued filling of vehicle tanks 5 and the standby cooling of the cargo compartments 27. Should such venting occur, the control system 95 senses the condition via the weight switch 93, after an "at rest" position is later reached, and automatically refills the tank 89 to the desired level. Thus, the ground support system provides a relatively low cost installation, from an equipment standpoint, yet is extremely economical in use because it stands ready to supply cold liquid carbon dioxide to the storage tanks of multiple vehicles with substantially no expenditure of carbon dioxide during the filling of the vehicle tanks or during stand-by cooling of their cargo compartments.

Various of the features of the invention are set forth in the claims which follow.

What is claimed is:

1. A method for filling vehicle tanks with low pressure liquid carbon dioxide and for providing standby cooling of the cargo compartments of said vehicles, which method comprises supplying a holding chamber with liquid $CO_2$ from a high pressure liquid $CO_2$ storage vessel system, reducing the pressure of said liquid $CO_2$ to about 60 p.s.i.g. or below to create $CO_2$ vapor and $CO_2$ snow thereby forming a low-temperature coolant reservoir of $CO_2$ snow in said holding chamber, removing and compressing said $CO_2$ vapor from said holding chamber and returning said compressed $CO_2$ vapor to said storage vessel system, supplying liquid $CO_2$ from said high pressure storage vessel system to the vehicle tank at a pressure below about 125 psig and condensing the vapor created as a result of the formation of said lower pressure liquid by melting said $CO_2$ snow in said holding chamber, flowing liquid $CO_2$ from said vehicle tank through heat exchange means in the cargo compartment and vaporizing said liquid therein to cool the cargo compartment, expanding said vapor from said heat exchange means to lower the temperature thereof, passing said expanded vapor through additional heat exchange means in the cargo compartment, and recovering said expanded vapor from said additional heat exchange means by compressing said vapor and injecting said compressed vapor into said holding chamber so as to condense said injected vapor by melting said solid $CO_2$ snow.

2. A method in accordance with claim 1 wherein an intermediate pool of liquid $CO_2$ is established at a pressure above said vehicle tank pressure, with the vapor from said pool being compressed and returned to said high pressure storage vessel system and wherein said vehicle tank is supplied from said intermediate pool by pressure differential flow.

3. A method in accordance with claim 2 wherein a plurality of vehicle tanks are simultaneously supplied from said intermediate pool and wherein vapor from said pool and from said vehicle tanks is combined and transferred together to said holding chamber at a pressure above about 65 psig.

4. Apparatus for filling vehicle tanks with low pressure liquid carbon dioxide, which apparatus comprises a holding chamber, a high pressure liquid $CO_2$ storage vessel system, means for supplying said holding chamber with liquid $CO_2$ from said storage vessel, means for reducing the pressure of said liquid $CO_2$ to about 60 psig or below to create $CO_2$ vapor and $CO_2$ snow and thereby form a low-temperature coolant reservoir of $CO_2$ snow in said holding chamber, a compressor connected between a vapor outlet from said holding chamber and said storage vessel system, means for operating said compressor to remove $CO_2$ vapor from said chamber, return said $CO_2$ vapor to said high pressure storage vessel system, means for supplying liquid $CO_2$ from said high pressure storage vessel system simultaneously to a plurality of vehicle tanks at a pressure below about 125 psig, and means for recovering the vapor created as a result of the formation of said lower pressure liquid $CO_2$ by flowing said vapor to said holding chamber where said vapor is condensed by melting said $CO_2$ snow in said holding chamber.

5. Apparatus in accordance with claim 4 which also provides standby cooling of the vehicle cargo compartments wherein first and second heat exchange means are located in a cargo compartment, means is provided for flowing liquid $CO_2$ from said vehicle tank through said first heat exchange means for vaporization therein, means is provided for expanding said vapor from said first heat exchange means to lower the temperature thereof, and means is provided for passing said expanded vapor through said second heat exchange means, wherein auxiliary compressing means is provided and connected to said second heat exchange for withdrawing said expanded vapor from said second heat exchange means and compressing said withdrawn vapor and wherein means is provided for injecting said compressed vapor into said holding chamber so as to condense said injected vapor by melting said $CO_2$ snow.

6. Apparatus in accordance with claim 5 wherein weight switch means is associated with said holding chamber, wherein a control system is provided and connected to said weight switch means and, wherein a remote-control valve and pressure regulation means is provided between said holding chamber vapor outlet and said compressor, said pressure regulator means being set below the triple point and said control system being adapted to open said remote-control valve after a predetermined weight of carbon dioxide is achieved in said holding chamber.

7. Apparatus in accordance with claim 6 wherein a parallel path is provided between said compressor and said vapor outlet and wherein second pressure regulator means is included therein which is set to maintain a pressure in said holding chamber slightly above the triple point.

8. Apparatus in accordance with claim 4 wherein an intermediate tank is provided and connected between said storage vessel system and said vehicle tanks, wherein means is provided for establishing a pool of liquid $CO_2$ in said intermediate tank and wherein means is provided for maintaining the pressure of said intermediate tank well below the pressure of said storage vessel system but slightly above said vehicle tank pressure so flow occurs by pressure differential.

9. Apparatus for supplying vehicle refrigeration systems with liquid carbon dioxide and for providing standby cooling of vehicle cargo compartments, said vehicle refrigeration systems each including a tank connected to heat-exchange means associated with the cargo compartment so that liquid $CO_2$ from the tank is evaporated in the heat-exchange means, which apparatus comprises a holding chamber, a high pressure liquid $CO_2$ storage vessel system, means for supplying said holding chamber with liquid $CO_2$ from said storage vessel, means associated with said holding chamber for reducing the pressure therewithin to the triple point or below and for creating $CO_2$ vapor and $CO_2$ snow to provide a low-temperature coolant reservoir in said holding chamber containing $CO_2$ snow, a compressor for recovering said created $CO_2$ vapor for return to said storage vessel system, means for supplying additional liquid $CO_2$ from said storage vessel system simultaneously to a plurality of vehicle refrigeration systems at a pressure below about 125 psig, and means for withdrawing $CO_2$ vapor from said vehicle refrigeration systems and recovering said withdrawn vapor by condensing said vapor by means of melting said $CO_2$ snow in said holding chamber.

10. Apparatus in accordance with claim 9 wherein an intermediate pressure tank is provided which is connected between said high pressure storage vessel system and said vehicle refrigeration system and wherein means is provided for establishing a pool of liquid $CO_2$ in said intermediate tank at a pressure below the pressure of said storage vessel system but above the pressure of said vehicle refrigeration systems so that liquid $CO_2$ flows by differential pressure into said vehicle refrigeration systems.

* * * * *